United States Patent [19]

Sachs

[11] 4,324,479

[45] Apr. 13, 1982

[54] FILM PROCESSING METHOD AND APPARATUS

[76] Inventor: Emanuel M. Sachs, 42 Old Middlesex Rd., Belmont, Mass. 02172

[21] Appl. No.: 90,394

[22] Filed: Nov. 1, 1979

[51] Int. Cl.[3] ..... G03D 3/08; G03D 3/06

[52] U.S. Cl. ..... 354/319; 354/324; 354/331; 137/565; 137/577; 137/587

[58] Field of Search ..... 354/297, 300, 307, 312, 354/313, 314, 315, 316, 318, 319, 320, 321, 322, 331, 337, 338, 324; 68/5 E, 22 B; 134/64 P, 122 P; 366/166; 137/565, 577, 587

[56] References Cited

U.S. PATENT DOCUMENTS

| | | | |
|---|---|---|---|
| 670,165 | 3/1901 | Sheppard | 354/315 |
| 1,946,627 | 2/1934 | Karrer | 68/22 B |
| 2,438,648 | 3/1948 | Rodack et al. | 366/166 |
| 2,562,588 | 7/1951 | Traiber | 354/324 |
| 2,781,655 | 2/1957 | Brown | 68/22 B |
| 3,057,282 | 10/1962 | Luboshez | 354/305 |
| 3,062,123 | 11/1962 | Limberger | 354/324 |
| 3,101,659 | 8/1963 | Hollands | 354/297 |
| 3,139,904 | 7/1964 | Wengel | 137/577 |
| 3,851,662 | 12/1974 | Jessop | 137/565 |
| 4,012,753 | 3/1977 | Schmidt | 354/321 |
| 4,166,688 | 9/1979 | Sachs | 354/331 |
| 4,168,117 | 9/1979 | Work | 354/324 |
| 4,171,716 | 10/1979 | Szabo et al. | 354/324 |
| 4,268,156 | 5/1981 | Kostiner | 354/324 |

FOREIGN PATENT DOCUMENTS

| | | | |
|---|---|---|---|
| 2260770 | 7/1973 | Fed. Rep. of Germany | 354/324 |

*Primary Examiner*—L. T. Hix
*Assistant Examiner*—Alan Mathews
*Attorney, Agent, or Firm*—Weingarten, Schurgin & Gagnebin

[57] ABSTRACT

An automatic film processor is provided with leakage control in the form of a closed loop fluid handling system to provide negative pressure in the processing tanks, a specialized outlet orifice for the processing tanks to maintain fluid level above the film plane, means for providing an inert atmosphere above the chemicals in the system reservoir involving the use of a specialized standpipe, a film drying section which utilizes the cooling fan for the unit, and a specialized multi-negative loading unit.

14 Claims, 15 Drawing Figures

FILM PROCESSING METHOD AND APPARATUS

FIELD OF INVENTION

This invention relates to film processing, and more particularly to a method and apparatus for automatically processing film in a self-contained unit.

BACKGROUND

In the past, film processing has been accomplished in a variety of ways with a large variety of equipment which is both massive and costly. Such equipment has been utilized, for instance, for processing x-ray films of all sizes from dental x-rays to chest x-rays. While the size and complexity of the equipment in part depends upon the size of the film processed, a relatively efficient film processing machine utilizes processing chambers which are formed by elongated rollers in rolling contact one with the other. Such a device is illustrated in U.S. Pat. No. 3,057,282 issued to Benjamin Ellen Luboshez on Oct. 9, 1962. In this patent, a fluid-tight film treating device includes a chamber bounded on two sides by parallel end plates and circumferentially by four or greater even numbers of rollers, each in rolling line contact with its two neighbors and all rotatable about parallel axes so that a strip or sheet of material may be passed between pairs of rollers at the nip thereof, and may be moved into and out of the chamber without substantial leakage of fluid from the chamber.

In U.S. Pat. No. 4,166,688 entitled Automatic Photographic Film Processor and Fluid-Tight Seals Therefor, a system of end plate sealing is described in which leakage at the end plates of the rolls is eliminated.

With this background established, it will be noted that a complete unit for the processing of x-ray films or the like, should include efficient means for loading, further leakage prevention, film drying and preventing of chemical oxidation for the developers and fixing materials in the system reservoirs. The incorporation of these features into the machine is needed to retain and exploit the novel advantages of the basic processing concept outlined above, notably compact size, simplicity and lack of exposure of the chemicals to the atmosphere. Moreover, when dental x-rays are processed in order to accomodate the small size of the x-ray negatives, the entire system must be miniaturized.

SUMMARY OF THE INVENTION

In order to accomplish the above enumerated features, an automatic photographic film processor or like device for treating sheets of materials, is provided in which one or more processing chambers is formed with parallel rollers positioned in longitudinal contact to provide a fluid-tight seal. Any number of rollers or configurations may be used to form the processing chambers. These chambers are provided with a closed loop fluid handling system in which the fluid in a processing chamber is maintained at a pressure lower than atmospheric pressure for preventing leakage of the fluid from between adjacent rollers. This so-called "negative" pressure is not so large as to result in any significant amount of air being ingested into the processing chambers. The negative pressure is maintained by locating the fluid reservoir below the position of the corresponding processing chamber, by exposing the top surface of the fluid in the reservoir to atmospheric pressure, and by providing a restricted orifice downstream of the pump normally utilized to pump the chemicals through the processing chambers. While the pump, in general, is a high-pressure pump, the restricted orifice in series with the chamber acts to throttle the pump pressure such that the pump may be considered as merely moving fluid through the processing chamber without affecting the negative pressure which results by the head produced by locating the reservoir as little as three or four inches below the processing chamber.

The level of fluid or chemicals within the chamber is maintained above the plane of the film passing through the processing chamber either by providing a centrally located outlet fixture with an upwardly offset inlet orifice or by providing that the inlet orifice straddle the film plane. In this latter case, the flow rate through the chamber is maintained at a rate exceeding the flow rate induced by gravity so that fluid completely bathes and surrounds the film. This particular fixture is exceedingly useful in the miniaturized situation for processing of dental x-ray films or the like in view of the limited amount of space available for theminiaturized processing chamber.

In the case of oxidizable chemicals utilized in the processing chambers, an inert atmosphere or bath of nitrogen is provided above the surface of the chemicals in the reservoir by providing a standpipe which extends from the portion of the reservoir above the fluid surface to a position below the fluid surface, such that air entering the standpipe reacts with the chemicals at the fluid surface to react out the oxygen in the air thereby leaving nitrogen trapped at the top surface of the reservoir. This prevents oxidation and deterioration of the chemicals within the reservoir and is useful in prolonging the shelf life of the chemicals be they developer, fixer, or any other oxidizable material. The standpipe may take on any of a variety of configurations. In one embodiment, the standpipe projects upwardly from the bottom of the tank to a position above the fluid level, or in an alternative embodiment, the cap for the reservoir may be provided with a downwardly projecting standpipe. In an automatically replenished system, overflow from the reservoir may flow down the sides of the standpipe into a drip pan which is spaced from the bottom of the reservoir, with replenishing chemicals being pumped in at any level below the top of the fluid in the reservoir. It will be appreciated that when utilized with the negative pressure concept mentioned above, replenishing pressure is kept to a minimum.

The self-contained unit is provided with a drying section downstream of the processing chambers, in which heater elements are provided on either side of the transported film. A slotted baffle is also provided through which the transported film passes. A blower located anywhere within the unit is provided both for cooling the processing chambers thereby minimizing the temperature control problems while at the same time directing forced air over the heating elements and into the baffled-off area where it is utilized to dry the film. The film is dried both by radiant heat and by convection, whereas only a minimal amount of energy from the heaters reaches the processing chambers and this heat is delivered by a radiant process with the majority of the energy removed by the convection currents about the transported film.

A manually loadable automatic loading system for the self-contained unit provides for the loading of multiple films through the utilization of a stacked series of slots into which the individual films are inserted. At the interior of the unit each slot is provided with paired individually driven rollers which are sequentially actuated so as to move the films into contact with the nip of the drive rollers for the first processing tank. Means are provided for sequentially actuating the pairs of rollers and for sensing when a film has moved from one pair of rollers into the nip of the first processing tank. An audible indicator is provided in one embodiment to indicate when films have been properly inserted into the slots provided.

Alternatively, a conveyor is utilized to transport the films to the aforementioned first nip. Thus, multiple films can be processed sequentially by positioning them end to end on the conveyor.

As will be appreciated, the subject system can be utilized for either very small films or for extremely large films depending on the application. In either case, a self contained unit and method is provided for efficiently processing film. It will also be appreciated that the leakage prevention system applies to systems other than the photographic systems where only a few inches of negative pressure is needed to prevent leakage. The system for extending the shelf life of chemicals through the utilization of a standpipe and a nitrogen inert gas applies likewise to systems other than photographic systems. The drying system, while specially adapted to a miniaturized self-contained photographic processing unit, may also be utilized in any system where a cooling fan is utilized and in which a portion of the system must be maintained at a cooler temperature whereas the remainder of the system is to provide drying through convective forces. The loading system described herein also has application for a greater number of manually operable materials handling systems.

BRIEF DESCRIPTION OF THE DRAWING

These and other features of the present invention are more fully set forth below in the detailed description of the preferred embodiment presented below for the purposes of illustration, and not by way of limitation, in the accompanying drawing of which.

DETAILED DESCRIPTION

Figure 1:
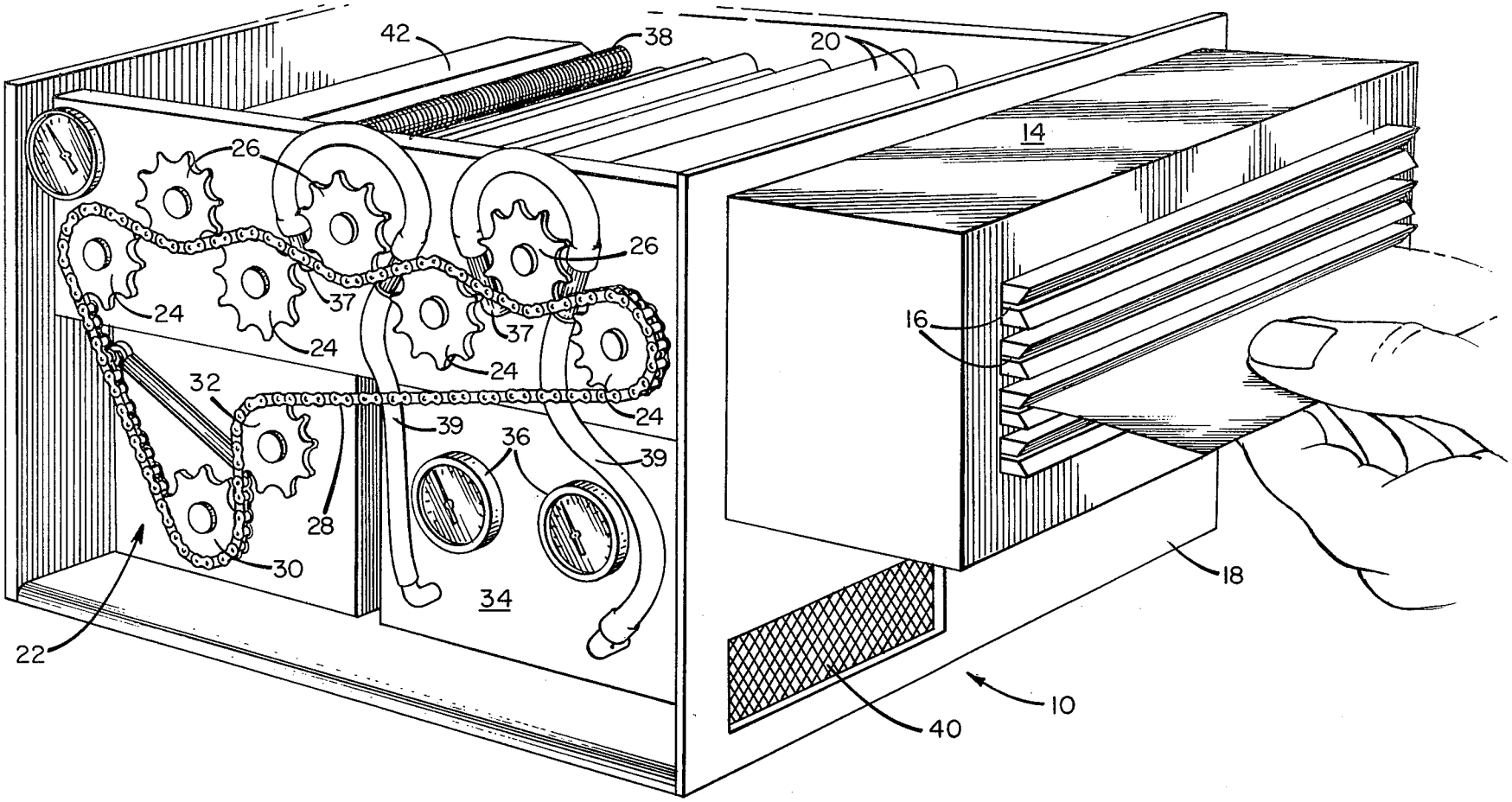
FIG. 1 is a diagramatic illustration of the subject apparatus illustrating the insertion of a film negative into one of a plurality of slots in the loading unit for the machine, also showing drive sprockets and reservoir return lines.

Referring now to FIG. 1 the subject unit 10 comprises a housing 12 shown with its top and sides removed. A stacked slot loader 14 is pictured having entrance slots 16 into which are inserted films 18 as illustrated. The unit includes a number of processing chambers formed by rollers 20 as will be described in connection with FIG. 2. The rollers are driven by a sprocket drive unit generally indicated by reference character 22 involving oppositely driven sprockets 24 and 26 via a chain drive 28 which is positioned around a drive sprocket 30 and take up idler 32.

A reservoir 34 which may be internally divided is provided beneath the plane of the processing chambers and is provided with temperature indicators 36, and fluid heaters and thermostats (not shown). Specialized outlet fittings 37 are provided for the two processing chambers utilized in the subject invention in which fluid is returned to reservoirs 34 over lines 39.

Downstream of the processing chambers are heaters generally indicated at 38 over which air from an inlet port 40 is provided. As will be described, cooling air from inlet port 40 is blown by a suitable fan or other means into housing 12 where it cools the processing chambers and then flows over heater elements 38 into a baffled-off area where it is utilized in heated form to dry the film after the film has been processed. In this figure, a portion of a baffle 42 is shown.

The leak-free fluid handling systems will be described in FIGS. 2, 3, 4, 5, and 6; specialized outlet fixtures in FIGS. 7A, 7B, 8, and 9A and 9B; the film drying apparatus in FIG. 10; and the specialized feed apparatus in FIGS. 11, 12, and 13.

FLUID HANDLING SYSTEM

Figure 2:
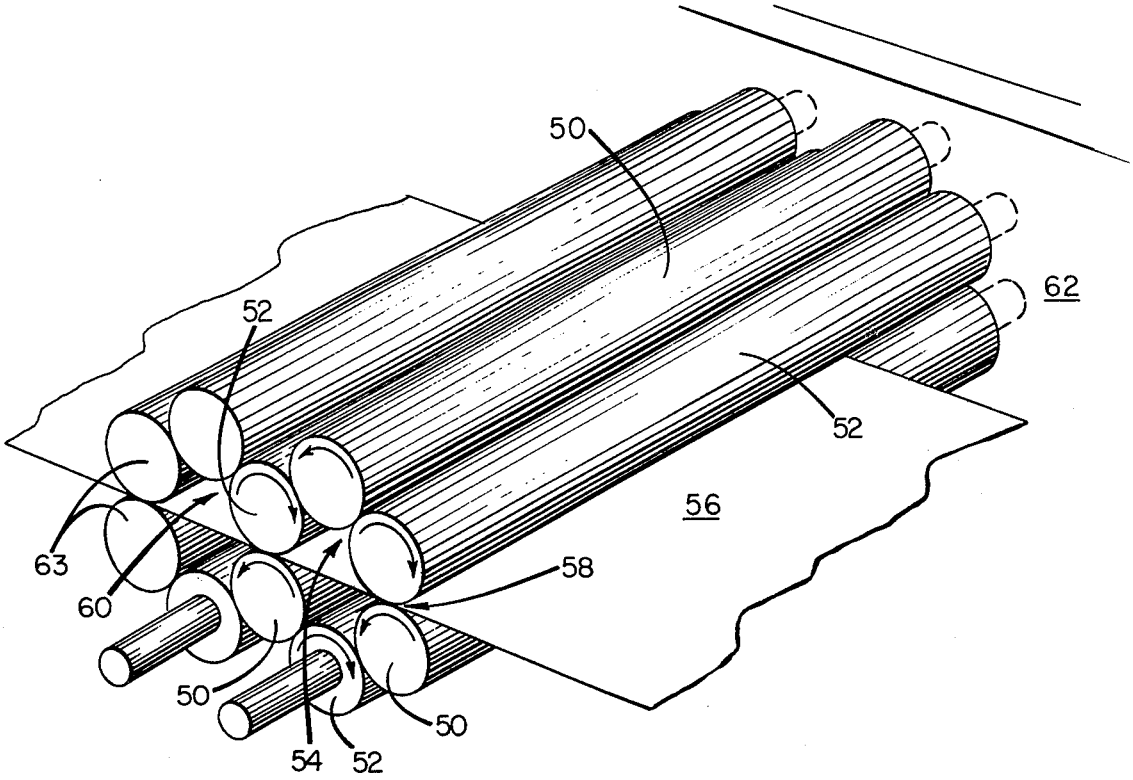
FIG. 2 is an isometric and diagramatic illustration of two processing chambers formed by longitudinally extending rollers.

As mentioned hereinbefore, it is known to build a photographic film processor using an even number of contacting oppositely rotating rollers forming processing chambers or tanks. Referring to FIG. 2 numbers of oppositely rotating rollers 50 and 52 are illustrated as forming a processing chamber 54 therebetween. Film 56 passes through a first nip 58 between the first set of oppositely rotating rollers, usually the drive rollers, and then passes through chamber 54. In the illustrated embodiment, film 56 then passes through a second processing chamber 60 formed in a similar manner. The ends of the rollers are sealed to end plates, here diagramtically illustrated at 62 as described in the aforementioned patent application. It will be appreciated that in the system illustrated there is nothing but rolling contact at the interfaces of all rollers. It is the region within the annulus of rollers that comprises the fluid-tight processing chamber. The fluid seal at the interface of the rollers is effected by compression of the rollers, that is, the center distance between the rollers is less than one roll diameter. Film is fed directly into the tank between drive rollers and travels straight through the tank and exits between drive rollers 63. Extra tanks may be formed by the addition of sets of four rollers to the configuration illustrated.

Processing fluids are pumped through the tanks, entering and leaving through holes in the side plates, the direction of fluid motion being perpendicular to the direction of film movement.

Figure 3:
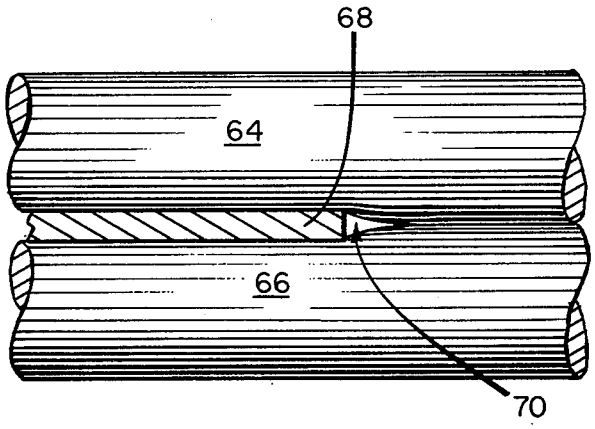
FIG. 3 is a cross-sectional illustration of the leakage path possible between the rollers of the processing chambers of FIG. 2.

It will be appreciated that upon entry of the film into the device, a small leakage path results around the film edge as the rollers are unable to completely conform to the film edges. This is illustrated in FIG. 3 in which rollers 64 and 66 accommodate a film strip 68. Noting that the roller surfaces are compressed about the film strip, a leakage path exists as illustrated by the area 70. If the fluid within the tank is at a pressure greater than atmospheric, leakage of this fluid to the outside will result. This presents two problems. First, fluid is lost before its chemical potential is exhausted, and secondly, the fluid is likely to bead up on the film at both the inlet and outlet ends of the device. This beading will result in uneven chemical action on the film which is a highly undesirable condition.

The solution to the leakage problem in the subject invention is to maintain the pressure within the tank slightly below atmospheric so as to insure that no fluid leaks out. It will be appreciated, however, that this must be accomplished with fluid being constantly circulated through the processing chambers as such circulation is necessary for uniform development of the film.

Figure 4:
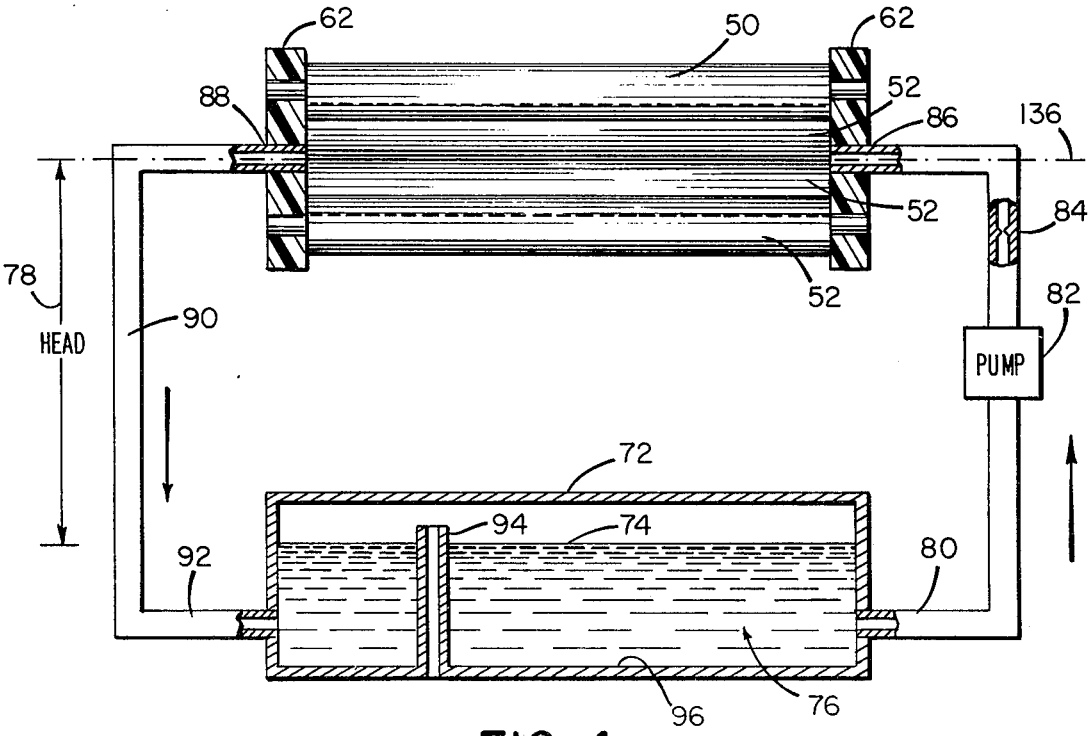
FIG. 4 is a cross-sectional and diagramatic illustration of the subject closed loop fluid handling system for the processing chambers of FIG. 2.

Referring to FIG. 4, in the present invention this is accomplished by arranging the fluid circulation such that first it is a closed loop system, and secondly, such that within a reservoir 72 there is a free surface 74 of fluid 76 which is exposed to atmospheric pressure at a position below the center line 78 of the processing tanks. Here the processing tank is illustrated by rollers 50 and 52 which are constrained by side portions 62. The pressure head as illustrated by arrow 78 in one embodiment need only be several inches to provide the required negative pressure. In this embodiment, a line 80 is coupled through a pump 82 and through a restricted orifice 84 to an inlet 86 of the processing tank. An outlet 88 is provided with a return line 90, with the return line being coupled as illustrated at 92 back to reservoir 72.

In the embodiment illustrated in FIG. 4, a standpipe 94 extends from the bottom 96 of reservoir 72 above fluid surface 74 to provide that surface 74 be exposed to atmospheric pressure. The purpose of utilizing a standpipe in this arrangement, as will be described hereinafter, is to provide for an inert bath of nitrogen to be formed at the top of the reservoir above fluid surface 74, thereby to prevent oxidation and thus deterioration of the chemicals within reservoir 72.

Negative pressure is provided in the processing chamber in the steady state by recognizing that once the system is completely filled, assuming that the fluid is stationary, the absolute pressure in the processor tank is given by:

$$P_{tank}=P_{ATM}-\rho gH$$

where $P_{ATM}$ is atmospheric pressure, $P_{tank}$ is the pressure within the tank, $\rho$ is the density of the fluid, H is the height of the point in question above the free surface of the fluid in the reservoir, and g is the acceleration of gravity. As gravity tends to pull the fluid out of the processing chamber, a vacuum develops which maintains the fluid within the chamber since the subject system is a closed system.

In this equation, $\rho gH$ is a negative hydrostatic pressure contribution due to the fact that the reservoirs are below the processing tanks. In one embodiment, the tanks are maintained three inches below the processing tank such that H equals three inches.

It will be appreciated that with the fluid moving through the processing tank, there are some frictional pressure drops in the outlet tubing 90 which adds to the pressure in the tanks such that the absolute tank pressure is given by:

$$P_{tank}=P_{ATM}+P_{LOSS}-\rho gH$$

where $P_{LOSS}$ is the pressure loss in the outlet tubing. In one embodiment, $P_{LOSS}$ is approximately equal to 1.5 to 2 inches. Thus it can be seen that for a three inch head, $\rho gh$, the negative pressure in the processing chamber is on the order of one inch.

It will be further appreciated that as long as $P_{LOSS}$ is less than $\rho gH$, the pressure in the processing tank is below atmospheric, the required condition. It will be appreciated that in order to obtain this condition the outlet plumbing and/or the flow rate must be such that the outlet plumbing provides low resistances and/or that the flow rate of the solution must be set so that the pressure within the tank is below atmospheric pressure.

It should also be noted that the maintainence of the tanks below atmospheric presure helps to minimize the adverse effects of any leakage mode, as air will leak in rather than solutions leaking out.

In order to maintain the proper flow through the processing chamber, so that the negative pressure condition is maintained within the processing tank, the outlet port of pump 82 is provided with a restrictor 84. In this case, any of a number of centrifical pumps may be utilized for pump 82 which in general may generate a couple of feet of pressure. In fact, a pulse type pump might also be used wherein the highest flow rate effected by the pump is such that the pressure within the processing tank is below atmospheric. However, this pressure is applied across a very small exit orifice, so that the pump acts not as a pressure source, but rather as a flow source. It will be realized that in the subject system, the orifice operates as a pressure-dropping device which when serially connected through the rest of the system, presents an orifice so small that the entire purpose of the pump is merely to move fluid through the chambers.

As mentioned hereinbefore, the pressure in the tank is at atmospheric pressure minus $\rho pH$ plus the losses in the exit line. The losses are due to the fittings and due to the line and also due to the flow rate in which the higher the flow, the higher the loss. As mentioned hereinbefore, usual losses are on the order of two inches which allows for a negative pressure on the order of one inch of water to be maintained in the tank.

In general, the flow rate through smaller units may be on the order of 200 cc's per minute, whereas the flow rate for the larger units may be as much as a couple of liters per minute. The flow rate is determined largely by the combination of orifice size and pump delivery pressure.

Because the orifice, in any event, is very much smaller than any other restriction within the system, maintaining a negative pressure within the tank of one inch is not difficult. This is because the pressure in the tank is, of course, determined by the sum of the resistances in the flow path and since the orifice provides the major resistance, the pressure downstream of the orifice is almost entirely due to the orifice itself.

Of course, if it is desirable to maximize a flow rate, since the flow rate is dependent almost solely on the orifice size, it is possible to adjust the orifice to maximize the flow rate while still maintaining one inch of negative head. Thus orifice 84 may be adjustable assuming some way of measuring the internal pressure of the tank is available.

NITROGEN BATHING EMBODIMENT

It will be seen that is an important feature of the circulation system that the free surfaces of the fluid be at atmospheric pressure. This might most easily be accomplished by simply providing a small hole in the top cover of the reservoir.

However, this would result in continued oxidation of the developer by the following mechanism.

The developer reacts with oxygen in the air at the top of the reservoir. This oxygen is pulled out leaving a nitrogen-enriched atmosphere above the solution which is in the reservoir. As nitrogen-enriched air is lighter than "normal" air, since nitrogen is lighter than oxygen, the atmosphere in the reservoir will tend to rise up out of the hole in the top of the reservoir, thereby making room for "normal" air. As will be appreciated, this process continues and the developer will continuously degrade.

This problem is solved by keeping the reservoir top cover sealed and installing standpipe 94 with an opening to the gas above fluid level 74 and an opening to atmosphere below the tank. The standpipe acts to maintain free surface 74 of the fluid at atmospheric pressure while also maintaining the processing solutions in an inert atmosphere. As the solution reacts with the gas in the reservoir it becomes nitrogen-enriched. The lighter nitrogen-enriched gas will not flow down the standpipe. Rather, air will be drawn up the standpipe to replace the initially reacted volume of oxygen. This process continues until the gas above the fluid consists essentially of nitrogen.

Thus, what has been provided is a nitrogen bath which is inert to most photoprocessing chemicals. It will be appreciated, therefore, that since air is composed of 80% nitrogen and 20% oxygen, a nitrogen bath for the reservoir may be provided without pumping bottled nitrogen across the top surfaces of the fluid.

Figure 5:
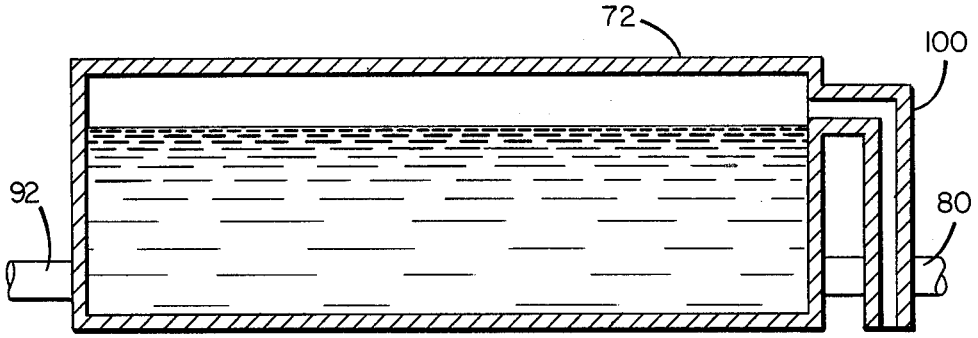
FIG. 5 is a cross-sectional illustration of an alternative standpipe embodiment.

The standpipe may be as illustrated in FIG. 4 which extends from the bottom of the tank to a position above fluid surface 74. Alternatively, the standpipe may be a downwardly projecting pipe 100 as illustrated in FIG. 5, where like apparatus of FIGS. 4 and 5 carry like reference characters.

It will be appreciated that the driving force keeping the nitrogen from flowing down the standpipe and out is the difference in density between air and nitrogen. Assigning an arbitrary density of 1.00 to air, nitrogen at the same temperature has a relative density of 0.97, the three percent difference being sufficient to ensure that the nitrogen does not leave the reservoir. Often, however, the processing solutions are kept at elevated temperatures, typically 95° F. to reduce the needed immersion times in the solutions and hence reduce the processing time. If the solutions are warm, they will serve to warm the gaseous atmosphere above them in the reservoirs. The result is a further decrease in the density of the gas above the solutions by approximately 4.5% in the case of 95° F. solutions in a 70° F. ambient. Thus, 95° F. nitrogen is approximately 7.5% lighter than 70° F. air. Thus, warning the solutions will tend to strengthen the driving force tending to keep the solutions in an inert nitrogen atmosphere.

This same concept may be applied to any tank containing processing chemistry, regardless of its size. All dark rooms and places where processing is done have large reservoirs which are used to contain solutions before they are drawn out into hand tanks or automatic processors. These large reservoirs are routinely fitted with floating lids to reduce the surface area exposed to oxidation. However, some surface is exposed, and oxidation does take place, rendering the chemicals ineffective within a few weeks time. Any such holding tank may be outfitted with a standpipe either internally or externally, thereby greatly extending the life of the processing solutions, principally the developer solutions.

Figure 6:
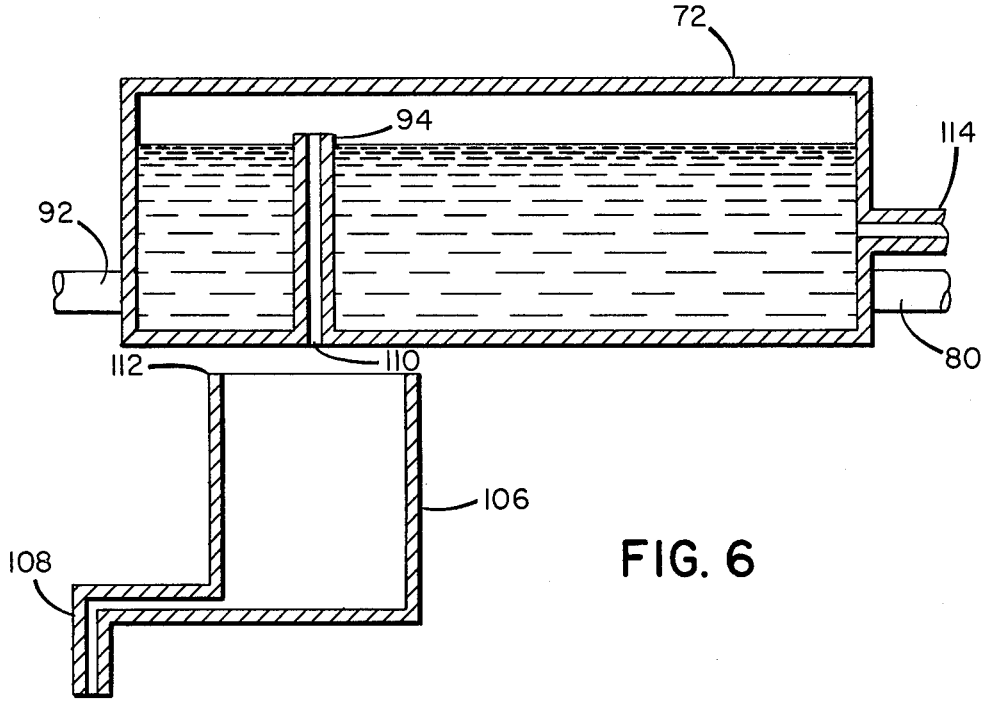
FIG. 6 is a cross-sectional illustration of a replenishing system utilizing the subject standpipe and a drip reservoir.

Referring now to FIG. 6, the subject closed circulation system may be provided with a replenishment system in which a replenishment pipe 114 is provided to reservoir 72. In this embodiment, fresh chemicals may be introduced into the reservoir 72 with the used or depleted chemicals exiting reservoir 72 by flowing down standpipe 94 into a further reservoir 106 and thence to a drain 108 therebeneath.

It should be noted that atmosphere inlet orifice 110 is not restricted in any way by the top 112 of reservoir 106 such that the replenishment system does not in any way affect the operation of the closed fluid handling system or the negative pressure which is maintained in the above-mentioned processing chambers.

It will, of course, be appreciated that the replenishment supply flow rate is gentle into reservoir 72 so as not to disturb the negative pressure within the processing chambers.

PROCESSING CHAMBER OUTLET ORIFICE

Figure 7A:
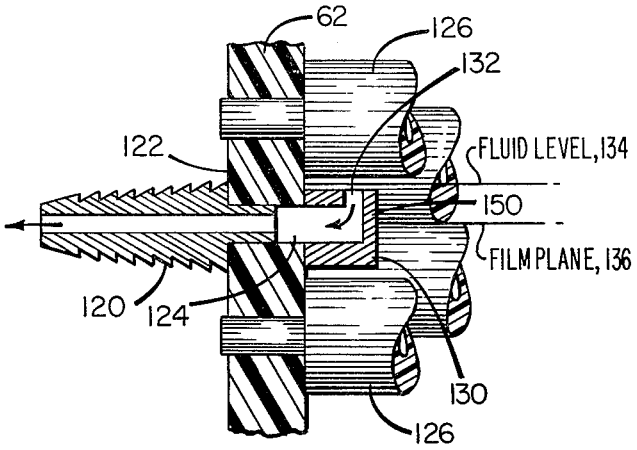
FIGS. 7A and 7B are cross-sectional diagrams illustrating respectively one embodiment of the outlet fitting utilized in the processing chambers of FIG. 2 in which the fluid level is maintained above the film plane for films passing through the processing chambers.

As mentioned hereinbefore, in one embodiment the processing unit is miniaturized so as be able to accommodate the relatively small dimensions of dental x-ray film. In order to accomplish this, the diameter of the chamber must be less than the length of the film sought to be processed. Since it is imperative to guarantee that the processing tank be filled with liquid above the plane of film traveling through the device so that total immersion of the film is guaranteed, the placing of the outlet orifice and more particularly its configuration, is important. If the tank is sufficiently large, the outlet port is merely placed above the film plane. However, in miniaturized systems this is not always possible. It is usually located along the center line of the processing tank. In order to provide a centrally located outlet fixture, the fixture must be designed such that the constantly circulating fluid rises above the film plane in order that it exit through the provided orifice. This is accomplished as illustrated in FIG. 7A in which a serrated pressure fit nozzle 120 is provided with an inlet extension 122 which protudes through an orifice 124 in a side wall 62, in which orifice 124 is centrally located between rollers 126.

Figure 7B:
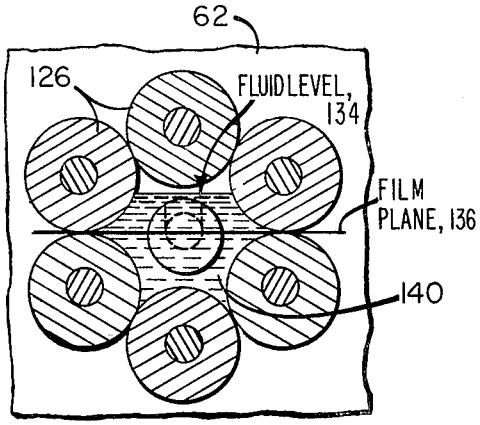

In this embodiment, a cap 130 having a vertically offset inlet orifice 132 is provided so that the fluid level 134 is maintained above the film plane 136 which is coincident with the central plane of the processing tank. Thus, as illustrated in FIG. 7B, film plane 136 is totally immersed in fluid 140 such that the fluid level 134 is maintained thereabove by the offset structure. Alternatively, any offset structure including bent tubing may be used or the offset structure may be machined into side plate 62.

Figure 8:
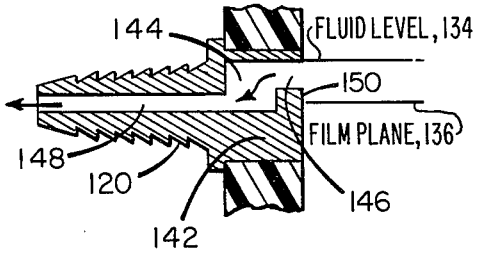
FIG. 8 is an alternative embodiment of the offset fitting pictured in FIG. 7.

As illustrated in FIG. 8, nozzle 120 may be provided with a central shank 142 which has an offset channel 144 extending upwardly with the inlet port 146 extending parallel to the outlet channel 148 of nozzle 120. In both the FIG. 7 and 8 embodiments, a barrier 150 is provided such that it extends above film plane 136, assuring that the film plane is totally immersed in the fluid carried by the processing chamber.

Figure 9A:
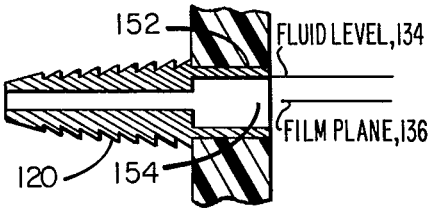
FIGS. 9A and 9B illustrate a still further embodiment for the outlet fitting in which the inlet orifice for the outlet fitting straddles the film plane.
Figure 9B:
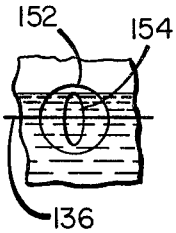

Referring to FIGS. 9A and 9B, nozzle 120 may be provided with a central extension 152 which has an inlet orifice 154 which straddles film plane 136. The cross-sectional configuration of the orifice is not important insofar that an orifice which straddles the film in the plane, may be made to work in the subject configuration. This can be understood by noting that if the level of the interface of a liquid with a much less dense gas is between the upper and lower extent of the inlet port, the top surface of the liquid in the tank must be at essentially the same pressure as the liquid immediately outside the exit orifice. If the pressure at the liquid-gas orifice were higher than the pressure immediately outside the orifice, the gas would immediately be driven out, and the liquid level would rise to the upper extent of the inlet port. Thus, with the interface level between the upper and lower extents of the inlet port, the exiting flow consists only of a flow due to the gravitational head within the liquid. For flow out a rectangular duct or weir it can be shown that this flow is given by:

$$\text{Flow} = c_d \frac{2\sqrt{2}}{3} \sqrt{g}\, bH^{3/2}$$

where: $c_d$ is a discharge coefficient accounting for such losses as vena contractor, its magnitude less than one; g is the acceleration of gravity; b is the width of the rectangular opening; and H is the height of the free liquid surface of the lowest extent of the rectangular opening.

From this it may be calculated, for example, that the greatest possible gravitationally induced flow out a 0.2 inch wide, 0.2 inch high orifice is approximately 200 cubic centimeters of water per minute. This calculation assumes that the free surface of the fluid is at the top of the orifice and a discharge coefficient of 0.6, a typical value.

Larger flows are possible only if the gas above the fluid is driven out, and the fluid level rises to the top of the orifice. Under these conditions, the top surface of the liquid may be maintained under pressure significantly greater than that on the outside of the exit orifice, and pressure-induced flow will add to the gravitationally induced flow.

It is, therefore, part of the FIG. 9 embodiment to maintain the liquid at the proper level by pumping through the processing chambers a flow volume exceeding the maximum possible gravitationally induced flow, thus requiring that the fluid rise to the top of the outlet port. This may be accomplished without providing that the internal pressure of the processing chamber go from its negative value to a positive value.

In summary, by adjusting the flow rate to a maximal value as described hereinabove, this automatically assures the condition that the flow will be greater than that induced by gravitational flow. Thus, should the FIG. 9A, 9B embodiment be preferred, the fluid level in the chamber will nonetheless be above the film plane.

FILM DRYING SECTION

Figure 10:
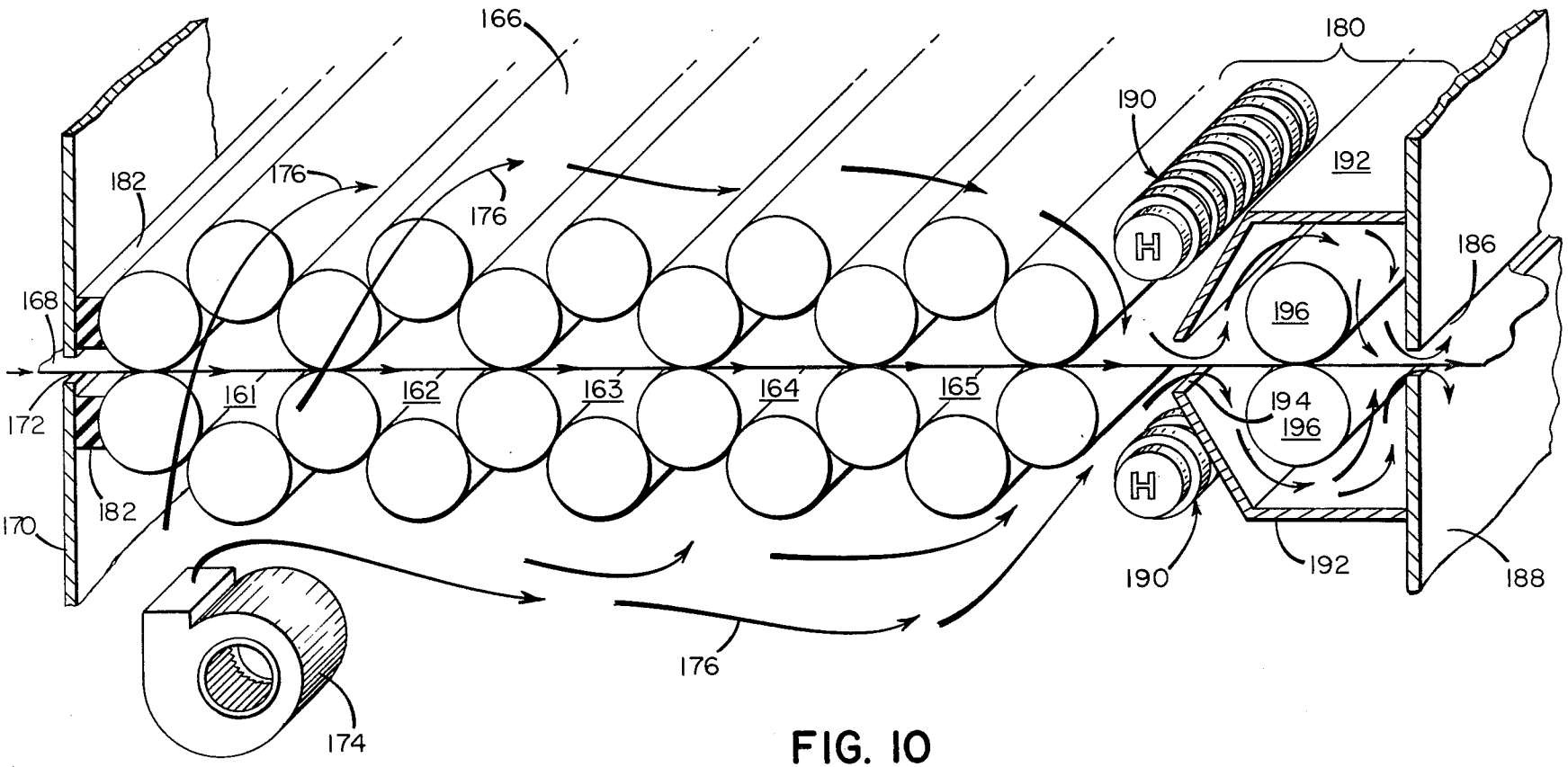
FIG. 10 is a diagramatic illustration of the film drying section for the subject unit.

Referring now to FIG. 10, in order to take full advantage of simplicity and compactness of the subject processor, it is important to provide such a processor with an effective film drying section so that once exposed films are inserted into the machine, complete processing from start to finish is accomplished.

In this embodiment, chambers 161, 162, 163, 164 and 165 are provided by rollers 166. Film here diagramatically illustrated by sheet 168 is inserted through a housing wall 170 at slot 172 and proceeds from left to right as illustrated. A fan or other air-moving means 174 is located anywhere within the housing so as to move air as illustrated by arrows 176 over the rollers so as to cool the chambers. This air also moves towards the film drying section here illustrated at 180. It will be noted that sealing means 182 are provided for the rollers at the entrance slot so that the only point of substantial egress of the air is at a slot 186 in wall 188 which is at the exit end of the machine.

A number of longitudinally extending heating elements 190 which may be electrically powered are provided at the exit nip for chamber 164. It is the purpose of these heating elements to heat the air moving in their direction, in one embodiment, to approximately 150° F.

A baffle structure 192 is provided downstream and to the right of the heating elements in which the baffle includes walls which are sealed to wall 188 and which has an entrance slot 194 through which the film and air travel. A pair of drive rollers 196 may be provided within the baffle structure so as to move the film through exit slot 186.

In this design the fan may be located within the housing and draws air into the machine. All exits for the air are substantially blocked except through the drying section. Thus, air is forced to follow the path indicated by arrows 176. As it flows by heaters 190, it impinges on film 168, and dries the film in a substantially even fashion by virtue of the convection currents produced. The baffle forms a flow guide or conduit for the exiting heated air and redirects it onto the film after the film exits chamber 164. It will be appreciated that the extra drive rollers 196 may be not be necessary for larger films, but allow the transport of even the smallest films through the dryer section.

What has been provided is a dryer section which allows one to maintain the compactness and simplicity of a straightline film transport. It will be appreciated that the fan is isolated from the drying section per se, which helps to ensure uniform air flow across the width of the film while allowing for compact design. The fan may be placed at any convenient location within the machine housing, doubling as both machine cooling fan and as a dryer fan. As mentioned hereinbefore, the only heating of the processing chambers is through radiant energy from the heating elements which is minimal. The drying therefore takes place with convective currents which are in a direction away from the processing sections.

AUTOMATIC FILM LOADING

Automatic loaders as presently configured are complicated and expensive pieces of equipment. At present, designs first unload the films from their cassettes before loading them into the processor. This requires a high degree of mechanical complexity. As an alternative, there are designs which load directly from a stack of films, one atop the other. One of the problems with such an approach is that films so stacked are very often hard to separate. Yet another approach which is currently available is to roll a large number of exposed films up into a continuous sheet arrangement and then unroll the films into the processor. This design is suited only to very high volume applications as the loading must be done in a separate machine and the films are processed on a last in-first out basis.

Thus is can be seen that conventional automatic loaders are complicated by two factors:

(1) They must handle large numbers of films; and/or (2) they attempt to accomplish too much of the loading task in that film in some cases must be unloaded from its cassette.

It should be noted that the vast majority of automatic loading applications require only the ability to accept a few films at a time. Thus the loader may be designed to accept only a small number of films and still retain its utility. If, in addition, film unloading and separation are accomplished by the operator, some simple approaches to automatic processing become feasible.

Figure 11:
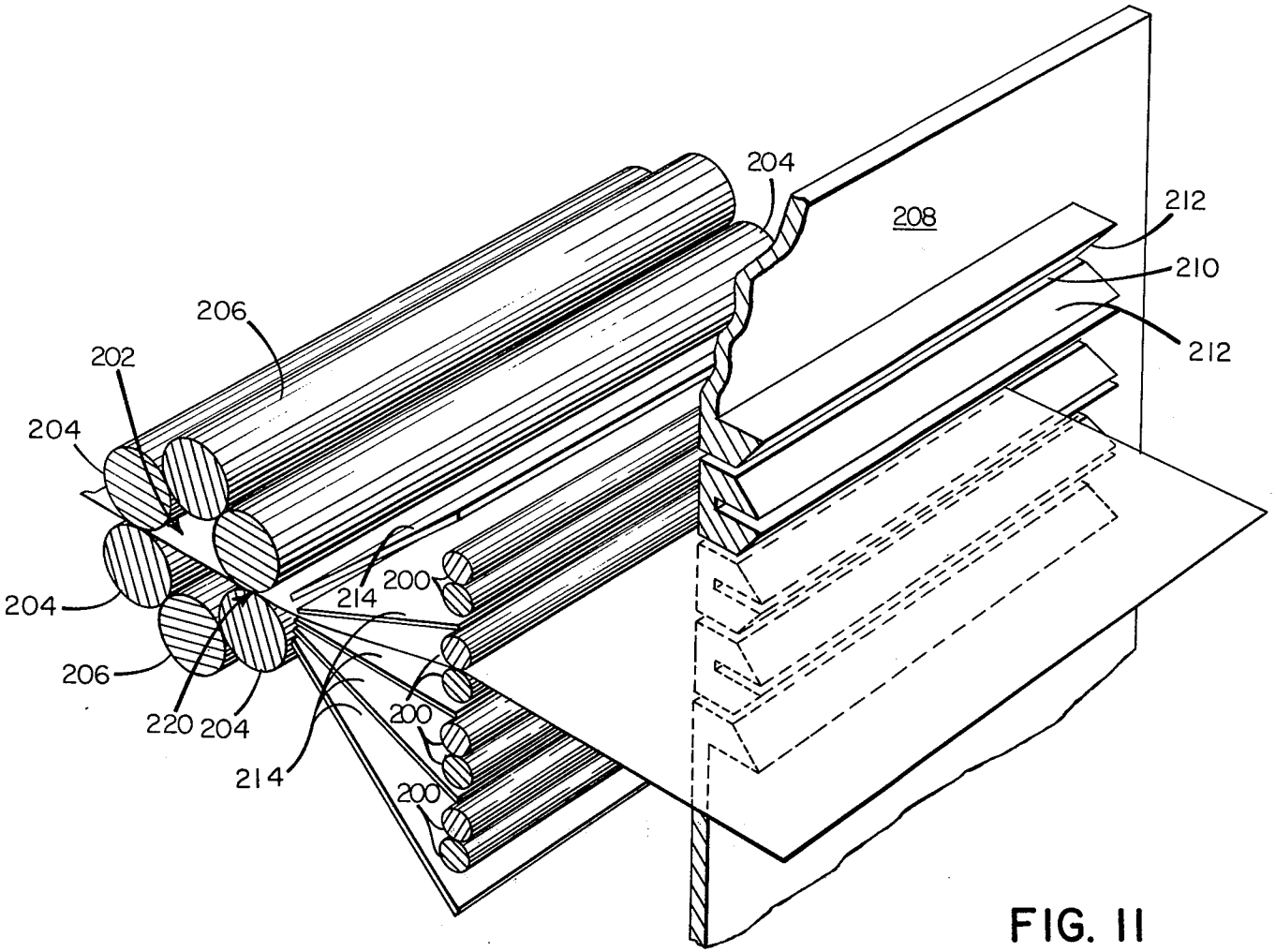
FIG. 11 is an isometric and diagramatic illustration of a stacked slot arrangement for feeding multiple films to the drive roll nip of the first processing tank of the unit.

Referring to FIG. 11, if small films are to be loaded such as would be the case in a dental-size automatic processor, a number of small diameter feed roller pairs 200 may be positioned directly in front of the first processing tank here illustrated at 202. This tank is made up of drive rollers 204 and idler rollers 206. A side wall 208 of the unit is provided with entrance slots 210 having opposing sloped guide portions 212 as illustrated. Each of these slots is positioned adjacent to a corresponding pair of drive rollers such that the film, when inserted into a slot, butts against the nip between the corresponding drive rollers.

Inclined chutes 214 are provided on either side of a pair of drive rollers to guide the film to nip 220 which exists between drive rollers 204.

Figure 12:
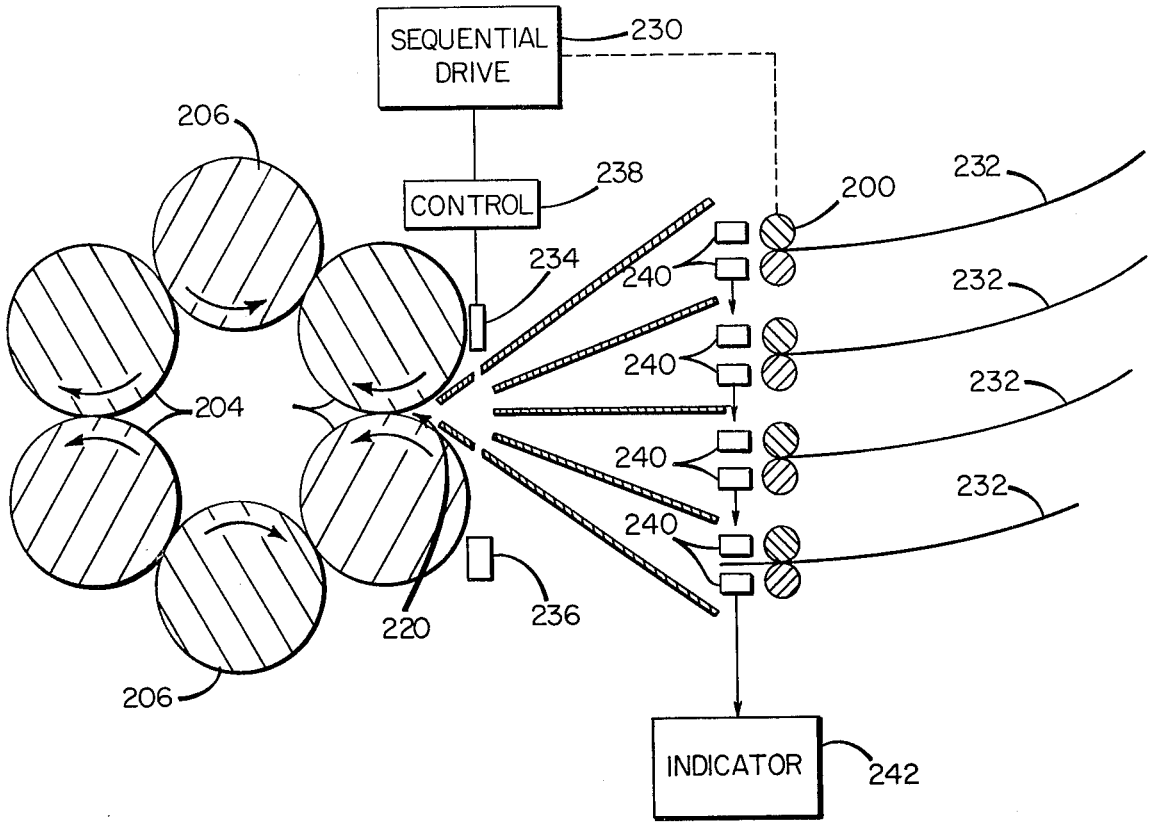
FIG. 12 is a diagramatic illustration of the sequential feed utilizing stacked slots illustrating control circuits for the stacked slot feed; and, FIG. 13 is a diagramatic illustration of a conveyorized sequential feed for films which are to be positioned at the first nip of the first processing tank.

Referring to FIG. 12 in which like parts have like reference characters with respect to FIG. 11, drive rollers 200 are provided with a drive unit 230 which sequentially actuates the drive rollers to drive film here diagramatically illustrated at 232 towards nip 220. The passage of film through the nip is monitored in one embodiment by a photo detector 234/light source 236 combination, the output of which is applied to a control circuit 238 which detects when a film which has been introduced into nip 220 has come to an end. At this point, control unit 238 actuates sequential drive unit 230 to actuate the next pair of drive rollers.

In order for the operator to determine that the film has been properly inserted, pairs of light sources and detectors 240 are provided immediately downstream of the drive rollers 200 such that when the film is properly inserted, an indicator alarm or light may be actuated. This assures proper positioning of the film through drive rollers 200 prior to the loading of the film into the first processing chamber. It will be appreciated that the photo detectors and sequential drive circuits and machinery are well known in the art and are not described herein.

As described, when the photo detector 234/light source 236 combination determines that the previous film has been fully loaded, a counter may be electronically incremented and the next pair of loading rollers may be actuated. In this manner, the loading rollers are continually sequenced and the films loaded.

As described above, the initial loading of the roller pairs may be accomplished simply by having the operator push the film in until sensors 240 are reached and a tone sounded, for example. The special advantage of this technique is that it helps ensure that the leading edge of the film is well aligned with the axis of the loading and processing rollers, as such alignment automatically results from butting the film up against a pair of non-driven rollers.

It is advantageous for the loading rollers to run at a surface speed higher than the actual linear processing speed so as to minimize the transit time from the ready position to the first nip of the processor. This requires, however, that the actuation of the loading rollers be only for a short, precisely controlled period of time as otherwise the film would curl up between the loading and processing rollers. In practice, this is accomplished by disengaging the loading roller drive at a specific time interval after the leading edge of the film has passed by the sensor pair 234/236. This interval should be chosen so as to ensure that the film reaches the processing roller while minimizing the amount of film curled up between the loading and processing rollers.

Alternatively, the means for driving loading roller pairs 200 may be torque-limited and simply allowed to stall or slow down to a speed commensurate with the processing speed once the film butts up against roller nip 220. This may be accomplished, for example, by using low-torque clock motors as the driving means, the requirements being that the loading force not be sufficient to curl up the film between loading rollers 200 and nip 220.

Figure 13:
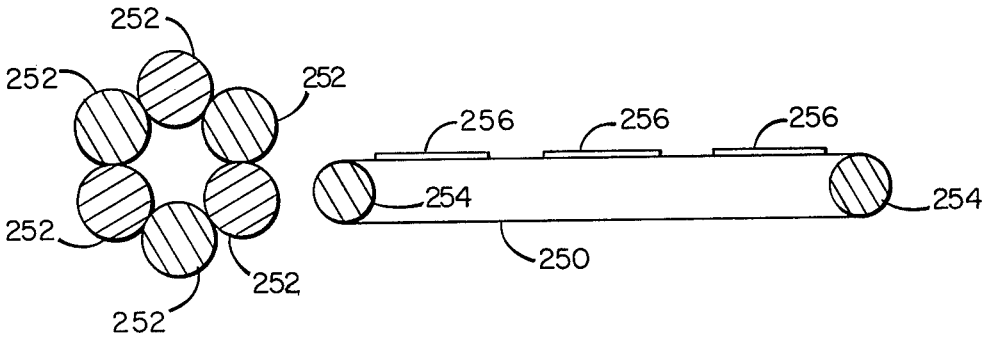

Referring now to FIG. 13, if small films are being loaded such as would be the case in a dental-size automatic processor, the loading may be done by means of a continuous belt 250 in front of the first processing chamber here illustrated by rollers 252. In such a configuration, belt 250 moves continuously over two rollers 254 at the same surface speed as the processor film transport speed. The operator simply places films 256 on the belt in the order in which they are to be processed. As the films approach the processor, they are caught in the first nip of the processor. If the processor is wide enough, several films may be simultaneously placed side by side.

What has therefore been provided is a unique processor and processing system which is compact, self-contained and is exceptionally efficient both in the utilization of chemicals and in the mechanical transporting of the films through the machine.

The invention is not to be limited by what has been particularly shown and described, except as indicated in the appended claims.

What is claimed is:

1. In an automatic film processor of the type in which the processing tanks are formed by a plurality of contacting rollers, a method of leak prevention comprising:

providing a processing tank with a closed loop liquid delivery system; and, controlling the pressure within the loop such that the internal tank pressure is less than the atmospheric pressure at the exterior of the tank.

2. In an automatic film processor of the type in which the processing tanks are formed by a plurality of contacting rollers, leak prevention apparatus comprising:

a closed loop liquid delivery system for each tank, said liquid delivery system having a reservoir and means for venting said reservoir to atmospheric pressure with said reservoir being located beneath the corresponding processing tank, said liquid delivery system including means for providing liquid from said reservoir to said corresponding tank and back to said reservoir such that the internal tank pressure is maintained at less than the atmospheric pressure exterior to said corresponding processing tank.

3. The apparatus of claim 2 wherein said liquid providing means includes a pump interposed between said reservoir and said tank, and a restricted orifice between said pump and said tank.

4. The apparatus of claim 2 wherein said venting means includes means for supplying air external to the reservoir at a position below the surface of the fluid within the reservoir to a position above the surface of the fluid within the reservoir.

5. The apparatus of claim 4 wherein said supplying means includes a standpipe exposed to the ambient at one end and exposed to the interior of said reservoir at its other end.

6. The apparatus of claim 5 wherein said standpipe is interior to said reservoir.

7. The apparatus of claim 6 wherein said one end of the standpipe is exposed through the bottom of said reservoir.

8. A method for maintaining the freshness of oxidizable chemicals within a reservoir comprising the step of:

providing a bath of nitrogen above the surface of the oxidizable chemicals in the reservoir by introducing air exterior to the reservoir at a position below the surface of the chemicals within the reservoir to a position above the surface of the chemicals within the reservoir, the reservoir being otherwise closed to the atmosphere.

9. Apparatus for maintaining the freshness of oxidizable chemicals within a reservoir comprising: means for providing a bath of nitrogen above the surface of the oxidizable chemicals in the reservoir including means for introducing air exterior to the reservoir at a position below the surface of the chemicals within the reservoir to a position above the surface of the chemicals within the reservoir, said reservoir being otherwise closed to the atmosphere.

10. The apparatus of claim 9 wherein said introducing means includes a standpipe exposed to the ambient at one end and exposed to the interior of said reservoir at its other end.

11. The apparatus of claim 10 wherein said standpipe is interior to said reservoir.

12. The apparatus of claim 11 wherein said one end of said standpipe is exposed through the bottom of the reservoir.

13. Apparatus for maintaining the fluid level within a film processing tank above a predetermined film plane established by film passing through said tank at a predetermined location comprising:

a film tank;

means for passing film through said tank to establish a film plane; and, an outlet fitting positioned on said tank such that the centerline of its outlet channel straddles said film plane, said outlet fitting having an inlet channel communicating with said outlet channel, said inlet channel having an inlet end opening above said film plane, thereby to provide an offset inlet orifice.

14. Apparatus for maintaining the fluid level within a film processing tank above a predetermined film plane established by film passing through said tank at a predetermined location, said fluid having a free surface, comprising:

a film processing tank;

means for passing film through said tank to establish said film plane;

an outlet fitting having a central channel;

means for mounting said outlet fitting on said tank such that said central channel straddles said film plane; and, means for providing fluid flow through said tank such that the flow rate therethrough exceeds the flow rate through said outlet induced by gravity when said free surface is at atmospheric pressure.

* * * * *